United States Patent [19]

Anandasakaran

[11] 4,078,543

[45] Mar. 14, 1978

[54] GAS BURNER COOKING UTENSIL SUPPORT

[76] Inventor: Namasivayam Anandasakaran, 3450—26M Wayne Ave., Bronx, New York, N.Y. 10467

[21] Appl. No.: 726,662

[22] Filed: Sep. 27, 1976

[51] Int. Cl.[2] ..... F24C 15/10

[52] U.S. Cl. ..... 126/215; 126/214 C

[58] Field of Search ..... 126/214 C, 215, 24, 126/50, 211

[56] References Cited

U.S. PATENT DOCUMENTS

| | | | |
|---|---|---|---|
| D. 142,617 | 10/1945 | Coleman | 126/214 C |
| 729,233 | 5/1903 | Steinhoff | 126/215 |
| 3,805,765 | 4/1974 | Nodae | 126/215 |

FOREIGN PATENT DOCUMENTS

| | | | |
|---|---|---|---|
| 32,658 | 12/1923 | Denmark | 126/214 C |
| 479,948 | 4/1953 | Italy | 126/214 C |
| 18,585 | 8/1907 | United Kingdom | 126/214 C |

*Primary Examiner*—Edward G. Favors
*Attorney, Agent, or Firm*—Robert D. Farkas

[57] ABSTRACT

A gas burner cooking utensil support, the improvement comprising a plurality of heat conductive arcuate ridges provided on the uppermost surface of the ring portion of the utensil support between the radially configured support arms of the utensil support.

3 Claims, 3 Drawing Figures

GAS BURNER COOKING UTENSIL SUPPORT

BACKGROUND OF THE INVENTION

1. Field of the Invention

The present invention relates to gas burner cooking utensil supports, and more particularly, to improvements thereto lowering fuel consumption.

2. Description of the Prior Art

Most typical gas burners employed in conventional gas stoves are used in conjunction with a cooking utensil support which supports a cooking utensil such as a frying pan or the like above the flame emanating from the gas jets. The cooking utensil supports presently available generally include a substantially flat ring portion for resting on the uppermost or designated surface of an oven. A plurality of support arms are each fixedly secured or integrally formed adjacent a free end thereof to the ring portion in a radially configured pattern. The uppermost surface of the support arms contact the lowermost surface of a cooking utensil placed thereon. A fairly substantial air gap exists between the uppermost surface of the support arms and the uppermost surface of the flat ring portion. The air necessary for combustion of the gas escaping from the gas jets is supplied through this air gap. Also, a substantial amount of heat is dissipated into the atmosphere through the air gap which might be used more effectively if heat is more effectively transferred into the cooking utensil.

The present invention provides an improved gas burner cooking utensil support which permits sufficient air to enter through the air gap to combust the gas supplied yet retains heat presently unnecessarily dissipated into the atmosphere thereby increasing the conduction of the heat to the cooking utensil.

SUMMARY OF THE INVENTION

Therefore, it is a primary object of the present invention to provide a gas burner cooking utensil support which reduces the amount of gas consumed by a conventional gas burner in heating a cooking utensil.

A further object is to establish a preferred ratio between ring portion height and support arm height at which sufficient air is available for combustion of supplied gas, yet minimal unused heat is dissipated into the atmosphere.

Another object is to provide a gas burner cooking utensil support which will aid in the conservation of gas and may be used with conventional gas stoves of current manufacture and presently in use.

These objects, as well as further objects and advantages, of the present invention will become readily apparent after reading the description of a non-limiting illustrated embodiment and the accompanying drawing.

The present invention provides a gas burner cooking utensil support which, when used in conjunction with an unmodified conventional gas range and burners, will conserve the gas expended to heat a cooking utensil. After considerable experimentation the air gap presently provided between the ring portion of a utensil support and the lowermost surface of a cooking utensil placed thereon has been determined to be wasteful. A substantial amount of heat is dissipated through the air gap into the atmosphere. The provision of a plurality of arcuate ridges on the uppermost surface of the ring portion of the cooking utensil support between the radially configured support arm thereof narrows the air gap. The narrowed air gap prevents the consumption of gas not transferring heat to the cooking utensil and still simultaneously permits the entrance of a sufficient amount of air to effect combustion. The ratio of the air gap determined to be most efficient is ascertained when the uppermost surface of the arcuate ridges is eight tenths the height of the uppermost surface of the radially disposed support arms. The height of the arcuate ridges and the support arms are measured from the lowermost surface of the support utensil.

BRIEF DESCRIPTION OF THE DRAWINGS

In order that the present invention may be more fully understood it will now be described, by way of example, with reference to the accompanying drawings in which.

DESCRIPTION OF THE PREFERRED EMBODIMENT

Figure 1:
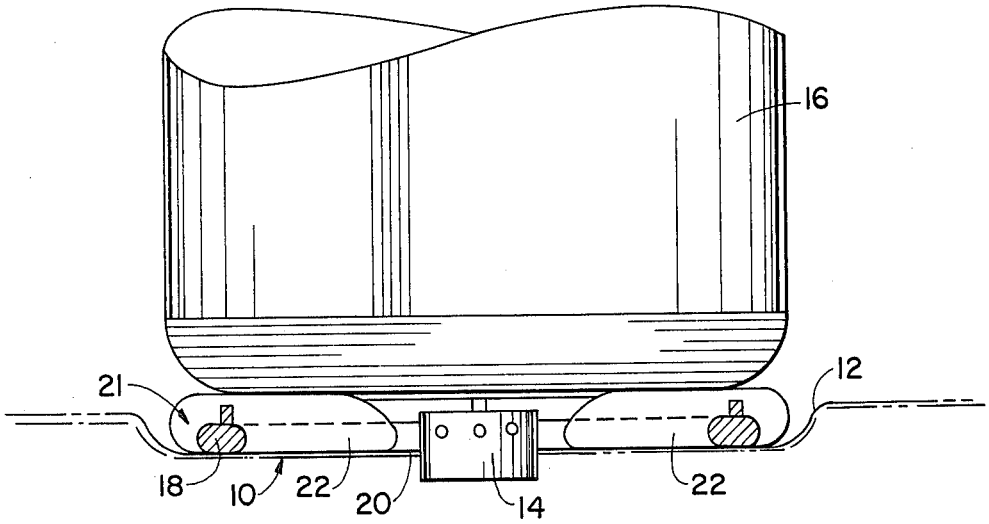
FIG. 1 is a side cross sectional view of the preferred embodiment of the present invention with a cooking utensil thereon.

Referring now to the drawings, and more particularly to FIG. 1 thereof, there is illustrated therein a gas burner cooking utensil support 10 resting on a conventional stove top 12. A gas jet 14 is located under a cooking utensil 16 resting on the utensil support 10.

Figure 2:
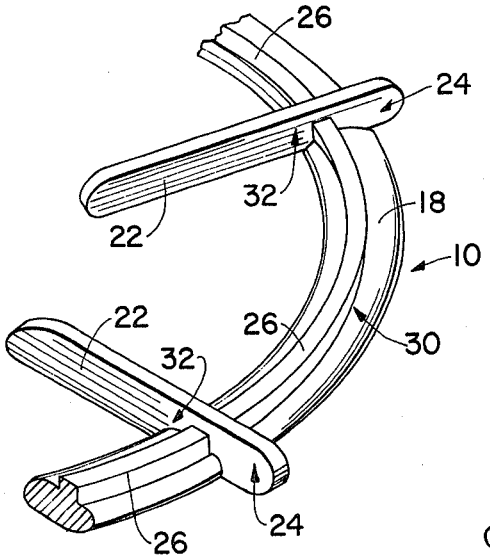
FIG. 2 is a perspective view of a section of the preferred embodiment.
Figure 3:
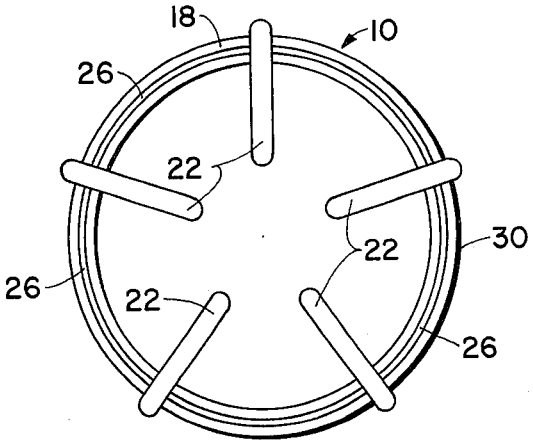
FIG. 3 is a top plan view of the preferred embodiment of FIGS. 1 and 2.

FIG. 2 illustrates a section of the utensil support. The utensil support includes a ring portion 18 also illustrated in FIG. 3. The lowermost surface 20 of the utensil support 10 is adapted to rest on the stove top 12 without any modification thereto, as shown in FIG. 1. A plurality of support arms 22 are each affixed adjacent to an end 24 thereof to the ring portion 18 in a radial pattern as shown in FIG. 3. Five support arms 22 are shown but any number or shape may be used. A plurality of arcuate ridges 26 are provided on the uppermost surface 28 of the ring portion 18. The edges 30 of each of the ridges 26 butt against the side surface 32 of the support arms 22. The ridges 26 preferably have a substantial rectangular cross-section although other shapes may be employed. The height of the arcuate ridges 26 should be such that sufficient air may reach the gas emanating from the gas jet 14 to permit combustion and minimizing dissipation of heat into the atmosphere. Experimentation has proven that the most effective height for the arcuate ridges may be expressed in the following equation:

$$H_r = 0.8\text{Ha}$$

where $H_r$ is the height of the ridges 26 measured from the lowermost surface 20 of the utensil support 10, and Ha is the height of the support arms also measured from the lowermost surface 20 of the utensil support 10.

FIG. 3 illustrates a top view of the cooking utensil support 10. The support 10 may be manufactured from cast iron or the like and may be supplied with newly purchased stoves or as a replacement accessories for stoves already in use.

It will be understood that various changes in the details, materials, arrangements of parts and operation conditions which have been herein described and illustrated in order to explain the nature of the invention may be made by those skilled in the art within the principles and scope of the invention.

Having thus set forth the nature of the invention, what is claimed is:

1. A gas burner cooking utensil support improvement comprising: a ring portion of said utensil support, radially disposed support arms of said utensil support, a plurality of arcuate ridges provided on the uppermost surface of said ring portion of said utensil support, said plurality of ridges provided between said radially disposed support arms of said utensil support and extending intermediate said uppermost surface of said ring portion and the uppermost surface of said radially disposed support arms, wherein the uppermost surface of said ridges is eight tenths the height of the uppermost surface of said radially disposed support arms, said height measured form the lowermost surface of said support utensil.

2. The utensil support as claimed in claim 1, wherein said arcuate ridges have a substantially rectangular cross section.

3. The utensil support as claimed in claim 1, wherein said ring portion and said plurality of ridges and said radially disposed support arms are a unitary construction.

* * * * *